US005334971A

United States Patent [19]

Raath

[11] Patent Number: 5,334,971

[45] Date of Patent: Aug. 2, 1994

[54] SECURITY DEVICE KIT, A SECURITY DEVICE AND A SECURITY INSTALLATION

[75] Inventor: Pieter L. Raath, Pretoria, South Africa

[73] Assignee: MODSEC Systems (Proprietary) Limited, Pretoria, South Africa

[21] Appl. No.: 941,543

[22] Filed: Sep. 8, 1992

[51] Int. Cl.[5] ..... G08B 13/22; E06B 9/01

[52] U.S. Cl. ..... 340/550; 49/50; 49/55

[58] Field of Search ..... 340/550; 49/50, 55; 52/633

[56] References Cited

U.S. PATENT DOCUMENTS

| | | | |
|---|---|---|---|
| 480,099 | 8/1892 | Hull | 109/82 |
| 485,506 | 11/1892 | Osbourne | 109/42 |
| 485,559 | 11/1892 | Osbourne | 109/42 |
| 489,902 | 1/1893 | Hull | 109/42 |
| 886,129 | 4/1908 | Jackson et al. | 52/727 |
| 1,575,343 | 3/1926 | Keller et al. | 109/42 |
| 1,787,350 | 12/1930 | Barton | 200/61.93 |
| 1,803,272 | 4/1931 | Greenley | 52/656.8 |
| 2,101,040 | 12/1937 | Bayley et al. | 340/550 |
| 2,125,807 | 8/1938 | Petty | 52/727 |
| 2,156,579 | 5/1939 | Bayon | 52/730.1 |
| 2,578,556 | 12/1951 | Johnston | 109/42 |
| 3,634,845 | 1/1972 | Colman | 340/508 |
| 4,178,588 | 12/1979 | Queren | 340/545 |
| 4,449,121 | 5/1984 | Sosa | 340/550 |
| 4,810,999 | 3/1989 | Moshier | 340/550 |
| 4,859,989 | 8/1989 | McPherson | 340/510 |

OTHER PUBLICATIONS

Brochure entitled "MODSEC. The Most Advanced Security System For All Buildings" distributed publicly in South Africa and Kenya since May 1992.

*Primary Examiner*—Glen R. Swann, III
*Attorney, Agent, or Firm*—Darby & Darby

[57] ABSTRACT

A pair of spaced elongate primary security members extend in a first direction, and each has a plurality of longitudinally spaced openings. The ends of a plurality of elongate secondary security members, extending in a second direction which is transverse to the first direction, are located in aligned openings in the primary security members. The ends of the secondary security members are thereby held captive in the primary security members. The secondary security members span a space between the primary security members, and the secondary security members are thus spaced apart from one another. A tertiary security member supports the secondary security members between the primary security members. An electrically operable burglar protection system, having an alarm, is connected to the security members.

10 Claims, 5 Drawing Sheets

SECURITY DEVICE KIT, A SECURITY DEVICE AND A SECURITY INSTALLATION

BACKGROUND OF THE INVENTION

This invention relates to a security device. It relates also to a security device kit, and to a security installation.

According to a first aspect of the invention, there is provided a security device kit, which comprises a pair of hollow elongate primary security members, with a plurality of longitudinally spaced primary openings being provided in a first side of each of the primary security members; and a plurality of elongate secondary security members, with the ends of each secondary security member being located in aligned openings in the primary security members when the first sides of the primary security members face each other, so that the ends of the secondary security members are thereby held captive in the primary security members, with the secondary members spanning the space between the primary security members.

The security members may be attachable to a surround, and may be hingedly or fixedly attachable to the surround. The surround may be a portion of a wall defining a wall or door opening, a door or window frame, a pillar, or the like, and these are hereinafter referred to generally as a 'surround'.

The components of the kit may thus be such that they can be assembled into burglar proofing for a door or window opening, a security gate, a window frame, a security door, a sliding door, or the like.

The primary security members may be of box section, and may include a cover panel which forms at least part of one of the sides of the box section once the secondary security members have been engaged with the primary security members.

The kit may include a tertiary security member for supporting the secondary security members between the primary security members, the tertiary security member thus having attachment means for attaching the secondary security members thereto. The tertiary security member may be of elongate form, and its attachment means may thus be spaced the same distance apart along it as the distance between the primary openings on the primary security members.

The tertiary security member may, in one embodiment of the invention, comprise a flat bar with its attachment means being in the form of longitudinally spaced openings therein. The openings may be accessible by means of inlets in the longitudinally extending edges of the bar. It may then also include a cover member non-removably attachable to the flat bar so as to span the inlets to the openings, once the tertiary security member is located in position with the secondary security members located in its Openings, thereby to hold the secondary security members captive in the openings.

In another embodiment of the invention, the tertiary security member may be hollow. It may then be of box section having first and second opposed panels on which its attachment means are provided, with its attachment means thus being capable of supporting the secondary security members and holding them in position. Its attachment means may comprise a plurality of longitudinally spaced openings, for receiving the secondary security members, in the panels, with the openings in the first panel being aligned with those in the second panel. The openings may be accessible by means of inlets in the longitudinally extending edges of the panels. The tertiary security member may then include a cover member which forms at least part of one of the sides of the tertiary member and which is securable to the first and second panels. Thus, once the cover member is secured to the first and second panels, it closes off the inlets to the openings so that the secondary security members are held captive in the tertiary security member.

It will be appreciated that each secondary security member may be provided in a plurality of sections, for example two sections.

One end of each section will then be engaged with an opening in each of the primary security members on assembling the kit, while their other ends will be engaged respectively with the opposed openings in the tertiary security member.

Instead of the cover panel and cover member of the primary and tertiary security members respectively, suitable mechanical locking means to prevent release of the secondary security members from the openings once they have been engaged therein, can be provided. The mechanical locking means may comprise suitable teeth or hooks in or on the primary and tertiary security members which permit engagement of the secondary security members in the openings but prevent disengagement thereof therefrom.

The kit may include securing members, such as grommets, which fit over the secondary security members and which engage the openings, e.g. engage the peripheries of the openings, in the primary and tertiary security members.

The device is thus in modular knock-down or kit form. A user will, in use, cut the secondary security members to desired lengths prior to attaching them to the primary security members, and the primary security members to the surround.

The primary security members can then also be cut to a desired length before use. A plurality of longitudinally spaced securing openings may be provided in second sides or panels, opposed to the first sides or panels, of the primary security members. In use, the primary members can thus be secured to the surround by suitable connecting members, e.g. expanding bolts, passing through these openings.

The spacing between the appropriate openings in the primary and tertiary security members may be such that, after assembly of the device, the secondary security members are spaced a sufficient distance apart so that a person, e.g. an intruder, cannot pass between adjacent secondary members. Thus, the secondary members may be spaced no more than 20 cm apart, typically about 12–15 cm apart, and may be spaced equidistantly apart. The secondary security members may extend at any desired angle, and will usually extend horizontally or vertically when the device is installed. They may extend parallel to one another.

According to a second aspect of the invention, there is provided a security device, which comprises a pair of spaced elongate primary security members extending generally in a first direction; and a plurality of elongate secondary security members extending generally in a second direction transverse to the first direction, with the ends of the secondary security members being located in aligned openings in the primary security members so that the secondary security members span the space between the primary security members, with the secondary security members being spaced apart from one another.

The primary security members may be solid, e.g. they may be in the form of flat bars. However, instead, they may be hollow, in which case they may be as hereinbefore described. The secondary security members may also be as hereinbefore described, with the ends of the secondary security members extending through the openings in the primary security members to effect coupling of the secondary security members to the primary security members.

The secondary security members may be releasably attached to the primary security members. When the primary security members are attached to a surround as hereinbefore described, the secondary security members are held captive in the primary security members, even though the ends of the secondary security members are located releasably in the longitudinally spaced openings of the primary security members.

The device may include a tertiary security member, as hereinbefore described, for greater rigidity and to assist in securing the secondary members in position.

Each secondary security member may comprise an outer hollow elongate component, and an inner elongate component extending along the inside of the outer component so as to be spaced therefrom. The components may be electrically conductive, and may be electrically insulated from each other. The components may be electrically connectable to an electrical current such that a potential difference can be provided between them, i.e. so that they are at different electrical potential. Each secondary security member may thus also comprise insulators electrically insulating the inner components from the outer components.

The outer components can be of any desired cross-sectional shape such as square, rectangular, circular, triangular, or the like. Typically, each outer component may be a length of square tubing.

The inner component may be a length of electrical wire which may then be sheathed with plastics insulating material, a solid bar, a hollow elongate component, or the like.

The device or apparatus may also include warning means operatively connected to the inner and outer components such that, on the inner and outer components being bridged electrically, i.e. short-circuited, or the electrical passage along one component being interrupted, the warning means is activated.

Thus, should it be attempted to breach the security device, e.g. by sawing or cutting the secondary members with a metal cutting device, the cutting device will bridge the inner and outer components electrically so that current flows from the one component to the other via the cutting device, thereby activating the warning means. The warning means will also be activated if only one of the components is severed so that the passage of electricity along it is interrupted. Any distortion of the security device sufficient to cause the first and second components to touch, will naturally also activate the warning device.

The security device may thus be attached or fixed to a dwelling unit, business premises, or the like, and the warning means; which may include an aural and/or visual alarm, may be part of a more-or-less conventional DC-operated burglar protection system fitted to the unit or premises.

The electrical connection of the inner and outer components to the alarm may be by means of electrical conductors or wires passing along the inside of the primary security members.

More particularly, the burglar protection system may be such that the inner components are at a low electrical potential, e.g. about 12 V, and the outer components at neutral voltage. The security device would then be harmless under normal conditions, with the inner energized components being protected by the outer components from outside interference, thereby to reduce false alarms. Upon electrical bridging of the inner and outer components, an alarm may then be generated as hereinbefore described. The device may then also include insulators insulating the outer components from the primary security members, and/or insulating material for insulating the primary security members from the surround to which they are attached.

However, the system may instead or additionally be such that the outer components are energized to deliver a non-lethal shock on touching thereof by an intruder. The system or device may thus include a control unit, operatively connected to the inner and outer components, for introducing a high voltage to the outer components when an alarm is generated as hereinbefore described. The control unit may thus include an electrical shock energizer electrically connected to the outer component.

Instead, the system may be such that the inner components can be energized to deliver the high voltage non-lethal shock. The system may then be such that the shock will only be delivered on an outer component being forced into electrical contact with its inner component, i.e. when an electrical short circuit is created.

Still further, the system may be such that the outer components are energized through the introduction of positive and negative electrical potential, e.g. +250 V and −250 V respectively, to alternative secondary security members, thus resulting in maximum potential difference between adjacent secondary members within the legal limits of electrical voltage inside buildings.

The insulators providing the electrical insulation between the inner and outer components may comprise end plugs of electrically insulative material located at the ends of the secondary members and separating or spacing the inner components from the outer components. The insulators or end plugs may each comprise an elongate body protruding into the end of the outer components, a peripheral flange protruding outwardly from the body at one end thereof and abutting against the end of the secondary member, and a passageway or recess in the body accommodating the inner component.

The electrical connection of the inner and outer components to the electrical conductors or wires may be by means of electrically conductive spring contacts or clips pressing against these components and located in the end plugs, with the contacts being connected or connectable to the electrical conductors.

The device may also include spacers of electrically insulative material at spaced intervals along the secondary members, the spacers spacing the inner components from the outer components.

The grommets may also be of electrically insulative material so that they insulate the secondary members from the primary and secondary members.

In one version of the invention, the secondary security members may span a wall opening, such as a window opening, so that the security device is in the form of burglar proofing for the opening.

In another version of the invention, the security device may be in the form of a window frame or a door frame, e.g. a sliding door frame, with the secondary security members forming frame components extending vertically or horizontally. In one embodiment of the invention, suitable channels extending along the secondary security members may be provided, with fixed window panes then being located between adjacent facing channels thereby to span the gap between adjacent secondary security members. In another embodiment of the invention, the window panes may be hingedly attached to the frame louvre-fashion so as to be pivotal about axes extending in the same direction as the secondary security members, with individual panes spanning the gaps between adjacent secondary security members. Naturally, the device may comprise a combination of the fixed window panes and the louvres.

In other versions of the invention, the security device may be in any other suitable form, e.g. in the form of a security door in which the secondary security members are sandwiched between outer door panels; a security fence or gate in which the secondary security members extend vertically and/or horizontally; burglar proofing for a door or window frame in which the security members are attached directly, e.g. by means of adhesive, to the frame; or the like.

If desired, connecting members, which fit snugly in the ends of the secondary members, as well as in the openings in the primary members, may be provided, so that the connectors connect the secondary members to the primary members. These connecting members may be of electrically insulating material. The ends of the secondary members will thus be accommodated in electrically insulating material of the connectors, which may be in the form of rubber grommets or the like. According to a third aspect of the invention, there is provided a security installation, which comprises a security device as hereinbefore described; and an electrically operable burglar protection system operatively connected to the security device.

The burglar protection system may be a more-or-less conventional DC-operated burglar protection system as hereinbefore described and which includes an aural and/or a visual alarm. It may also be capable of performing the energizing of the inner and outer components as hereinbefore described, and may thus include an electrical shock energizer as hereinbefore described.

The invention will now be described by way of example with reference to the accompanying diagrammatic drawings.

DETAILED DESCRIPTION OF THE INVENTION

Figure 1:
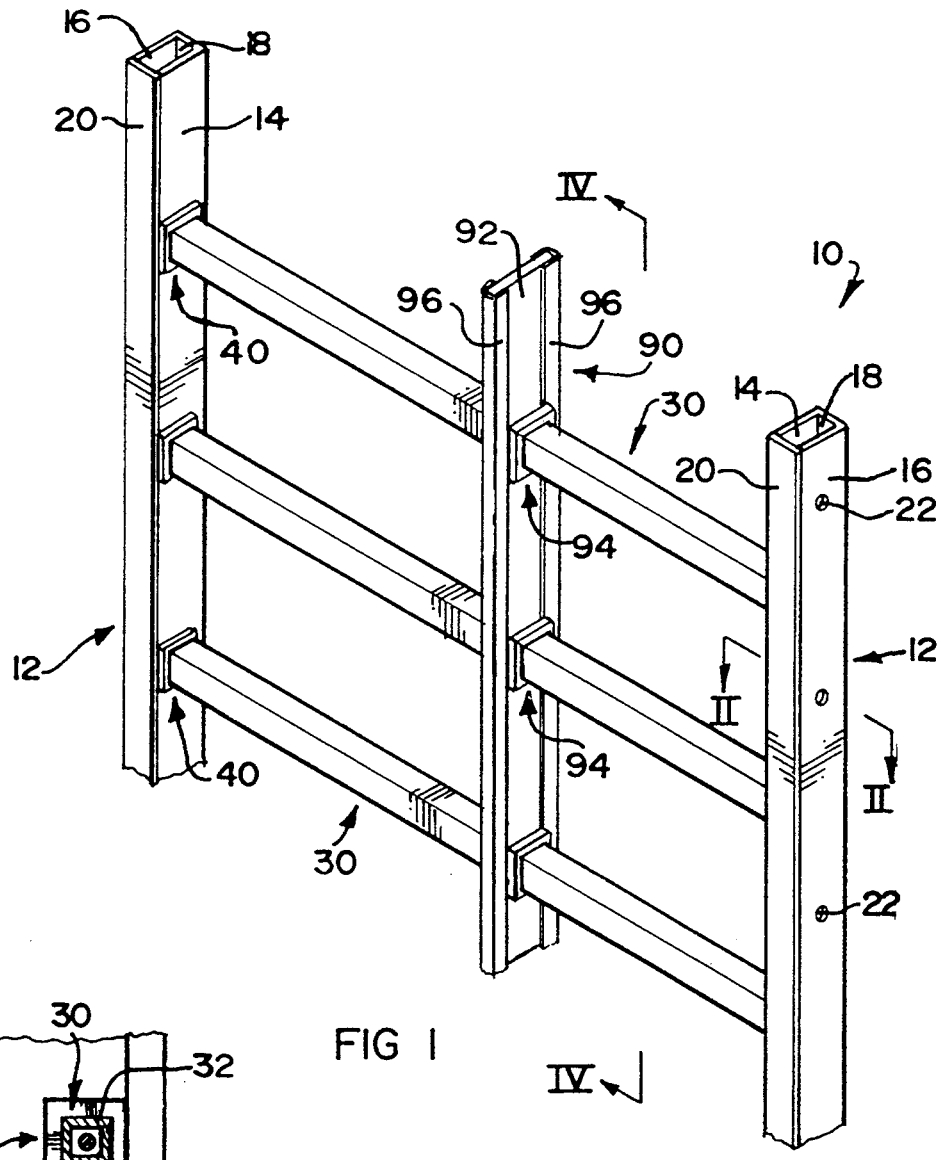
FIG. 1 shows a three-dimensional view of a security device according to a first embodiment of the invention.
Figure 3:
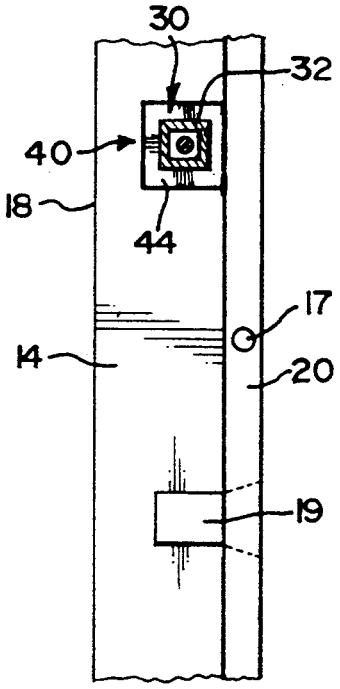
FIG. 3 shows a sectional view through III—III in FIG. 2.
Figure 2:
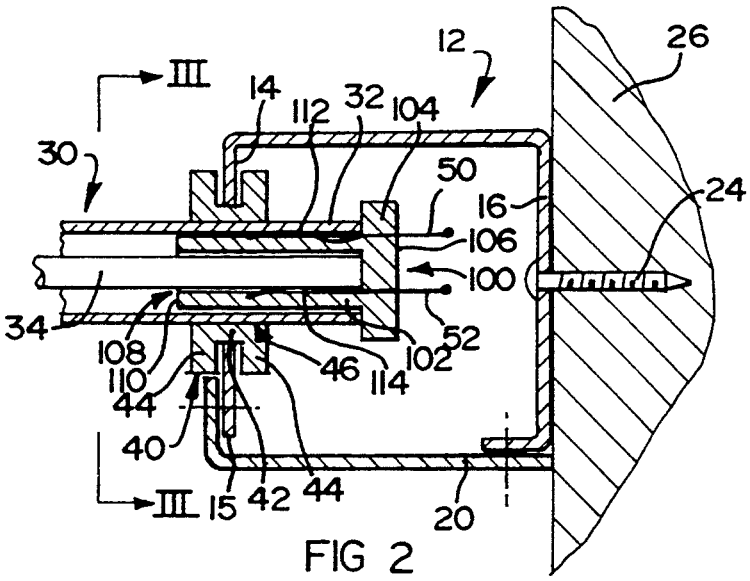
FIG. 2 shows a vertical sectional view through II—II in FIG. 1.
Figure 4:
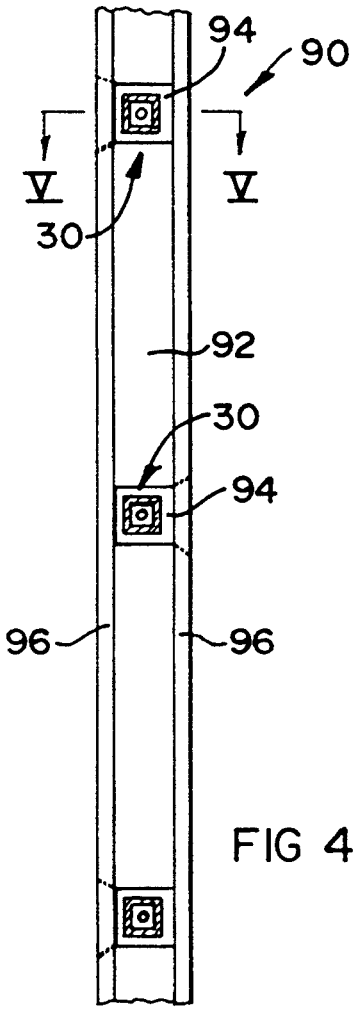
FIG. 4 shows a sectional view through IV—IV in FIG. 1.
Figure 5:
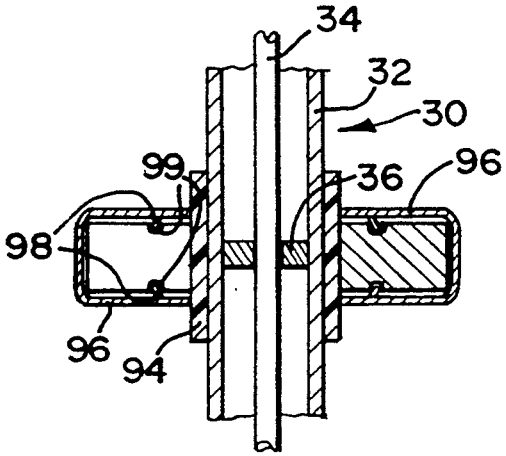
FIG. 5 shows a sectional view through V—V in FIG. 4.
Figure 7:
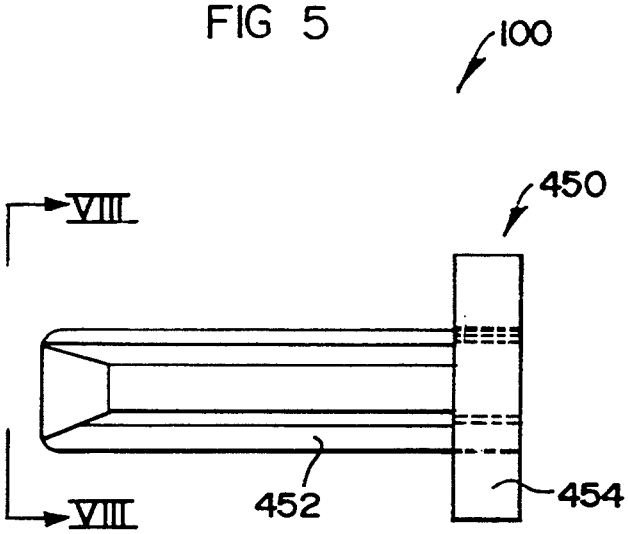
FIG. 7 shows an enlarged side view of the insulator or end plug of FIG. 2.
Figure 8:
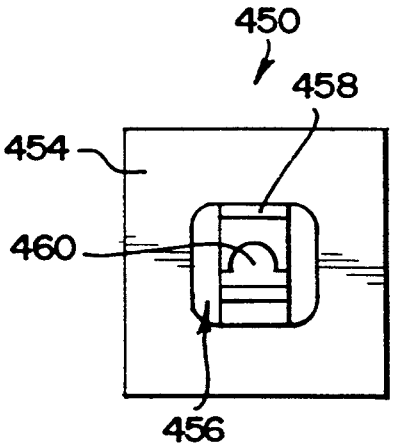
FIG. 8 shows an end view along VIII—VIII of the insulator of FIG. 7.
Figure 6:
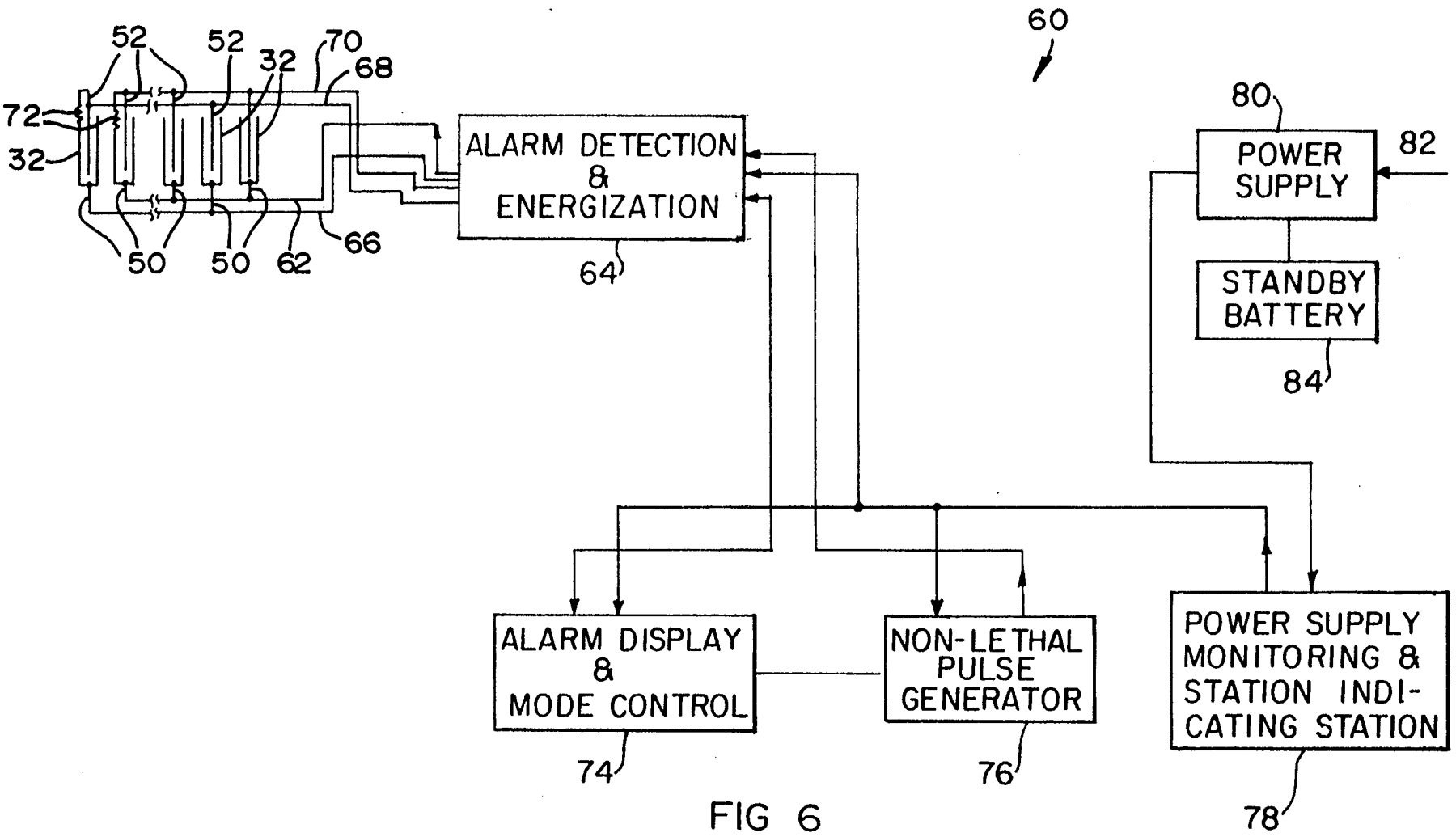
FIG. 6 shows a simplified wiring diagram of a burglar alarm system and electrical energizer coupled to the device of FIG. 1.

Referring to FIGS. 1 to 8, reference numeral 10 generally indicates a security device according to a first embodiment of the invention.

The device 10 comprises a pair of hollow box-section primary security members 12 which will extend vertically upwardly. Instead, however, they can also extend horizontally. Each of the members thus has opposed sides or panels 14, 16, as well as opposed sides or panels 18, 20 extending orthogonally to the sides 14, 16. The panels 20 are in the form of loose cover plates which, once the device 10 has been assembled and installed, are secured in position by means of rivets, tackwelding adhesive, or the like. For example, they can be provided with openings 17 for rivets. A plurality of longitudinally spaced openings 19, accessible from a longitudinally extending edge 15 of the panel 14 are provided in the panels 14. The panels 20, once secured in position, close off access to the openings 19.

Longitudinally spaced openings 22 are provided in the sides 16. In use, the members 12 will be attached by suitable securing means, e.g. screws 24 or expanding bolts (not shown), passing through the openings 22, to a surround or wall portion 26 defining a window opening (not shown). Thus, the primary security members 12 will be located on opposite sides of the window opening.

The device 10 also includes a plurality of horizontally extending vertically spaced secondary security members 30. Typically, the members 30 are spaced 12–15 cm apart so that intruders cannot pass between them. They thus constitute burglar bars extending between the primary members. The members 30 are initially releasably attached to the members 12 by means of the openings 19 in which they are located and the cover plates 20. However, once the device 10 is located in position with the primary security members 12 attached to the wall as hereinbefore described, and the cover plates 20 secured in position, the security members 30 are held captive in the members 12 and can then no longer be detached from the security members 12.

Each of the secondary security members 30 comprises an elongate hollow square section outer component 32. The outer component 32 is typically a length of square tubing or the like. Each member 30 also comprises an inner component 34 mounted with clearance inside the component 32 by means of electrically insulative end plugs 100. The component 32 is typically in the form of a solid circular-section rod.

The device 10 includes a plurality of grommets 40 for use in connecting the security members 30 to the security members 12. Each grommet 40 is of electrically insulative material, and comprises a body 42, spaced flanges 44 protruding peripherally outwardly from the body, and a central passageway 46 extending through the body. The body 42 of the grommet 40 fits snugly into one of the openings 19 in the panels 14 of the members 12, so that the flanges 44 abut against either side of the panel 14. The security member 30 fits snugly into the passageway 46 so that the grommet 40 holds the security member 30 captive in the primary security member 12 in electrically insulative fashion.

The device 10 also includes an end plug 100 at each end of each security member 34. Each end plug 100 comprises an elongate hollow body 102 which is square in cross-section, a flange 104 protruding peripherally outwardly from a first end 106 of the body, and a blind passageway 108 extending into the body from its other end 110. The outer component 32 is electrically connected to an electric wire 50 by means of a leaf spring clip or contact 112 embedded in the plug body 102, while the inner component 34 is electrically connected to an electric wire 52 by means of a leaf spring clip or contact 114 also embedded in the body 102 and protruding into the passageway 108.

The wires 50, 52 extend along the insides of the security members 12 and are electrically connected to a control panel of a household burglar alarm system, generally indicated by reference numeral 60.

Alternate wires 50 are connected to an electrical wire 62 which lead to an alarm detection and energization station 64. The other wires 50 are connected to an electrical wire 66 which also leads to the station 64. Similarly, alternate wires 52 are connected to an electrical wire 68 leading to the station 64, while the other wires 52 are connected to the station 64 by means of an electrical wire 70. The wire 62 is connected to the wire 70 by means of a resistor 72, while a similar resistor 72 connects the wires 66, 68. Suitable earthing connections (not shown) are also provided.

The station 64 is electrically connected to an alarm display and mode control station 74, to a non-lethal pulse generator 76, and to a power supply monitoring and station indicating station 78. The system 60 also includes a power supply station 80 fed by a mains power supply 82, as well as a standby battery 84.

The system is such that a particular mode of operation can be selected. In a first mode, bridging of adjacent members 30, or bridging of the components 32, 34 of a particular member 30, or interruption of electrical current along one of the components 32, 34, an alarm only can be emitted. Thus, the components 32, 34 are at different electrical potential. In another mode, a non-lethal electrical shock can be imparted to an intruder on one of these activities taking place, with or without the sounding of the alarm. The system may thus be such that, in the first mode, a relatively low voltage is used, e.g. 24 V DC, while in the second mode a higher voltage, e.g. +500 V AC in alternate members 30, and −500 V AC in the other members 30, may be used. The system may also be such that the outer components 32 are normally more-or-less neutral, and that a current is only supplied thereto on one of these activities taking place. To ensure good electrical contact, the components can be painted or coated with an electrically conducting paint and, optionally, treated against corrosion.

The device also includes a tertiary security member or support 90. The support 90 is located between the primary members 12, and comprises an inner flat bar 92 having a plurality of longitudinally spaced openings at the same intervals as the openings in the member 12, and being accessible from one of the longitudinally extending edges of the flat bar 92. The member 30 are located in this opening and thus supported by the support 90. The members 30 are held in electrically insulative grommets 94, and are retained in position by elongate clips 96 held captive by means of prongs 98 which engage recesses 99 in the flat bar 92.

In another embodiment of the invention (not shown). the openings in the bar 92 may be provided with protrusions, e.g. opposed hook formations, which permit entry of the members 30 into the openings but prevent disengagement thereof from the openings. The clips 96 can then be dispensed with, if desired.

In use, the components of the device 10 will be provided in modular knock-down or kit form. A user can then cut, e.g. saw, the members 12, 90 and the components 32, 34, to desired length to fit the window opening in question. The components 34 can then be fitted inside the components 32 and secured in position by means of the end plugs 100. Thereafter, the members 12 are located in position and secured in position to the wall surround 26 so that the sides 14 of the members 12 thus face each other. The members 30 are then located in the openings 19 in the members 12, and secured in position by means of the grommets 40, as hereinbefore described. The electrical wires are connected to the burglar alarm system, and the panels 20 then secured in position. The panels 20 will face towards the house.

Should a would-be intruder attempt to saw through the components 32, the sawblade will bridge the components 32, 34 electrically thereby activating the alarm. The same occurs in the event that current flow along one of them is merely interrupted during such sawing. Simultaneously an unpleasant non-lethal or non-incapacitating electrical shock can be imparted to the intruder due to the high-voltage low current if such mode of operation is selected. In addition, the components 34 may rotate as the sawteeth engage them, thereby resisting penetration of the sawteeth into the components 34. In this fashion, severing of the components 34 is prevented or hindered.

The Applicant believes that the device 10, apart from being in modular form so that it can be used for any sized window opening by merely cutting the members 12, 30 into appropriate lengths, also has the advantage of having the components 34 which resist sawing, as hereinbefore described. It can, furthermore, be assembled and installed quickly and easily, and provides protection against burglars. Attempts to force the secondary security members apart are also hampered thereby that their ends are held captive in the primary security members, but are not fixedly attached thereto so that the secondary security members can move longitudinally with respect to the primary security members by having limited 'give' with regard thereto.

Figure 9:
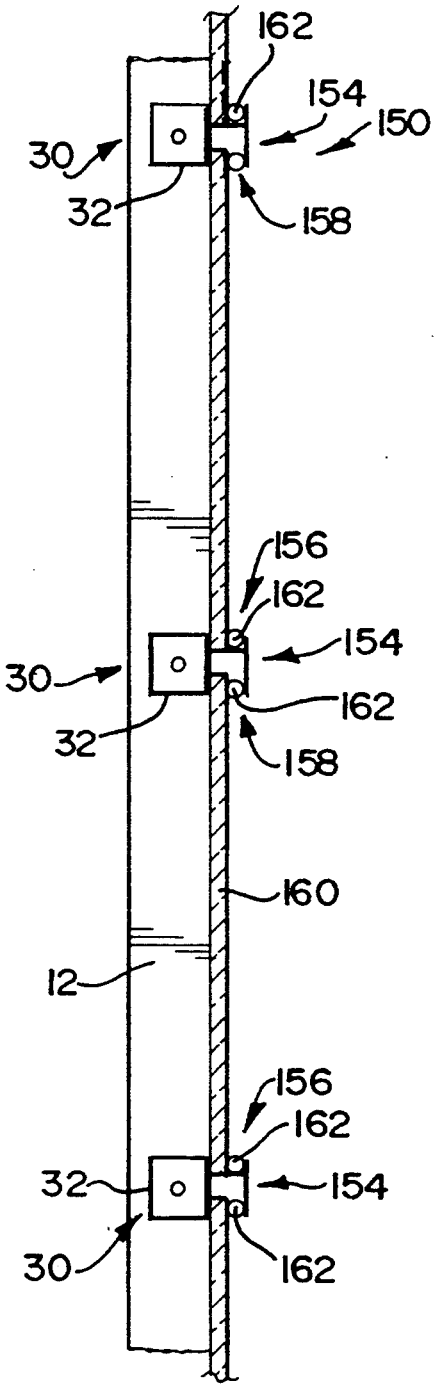
FIG. 9 shows a vertical sectional view of a security device according to a third embodiment of the invention.

Referring to FIG. 9, reference numeral 150 generally indicates a security device according to a third embodiment of the invention.

Parts of the security device 150 which are the same or similar to those of the security device 10 are indicated with the same reference numerals.

The device 150 also includes primary security members 12 and secondary securing members 30 spanning a window opening.

To one side of the component 32 of each of the members 30 is attached a bracket 154. The brackets 154 extend along the components 32 and provide opposed channels 156 and 158 respectively. The channel 156 is shallower than the channel 158. A window pane 160 is located in adjacent facing channels 156, 158 and secured in position by means of suitable seals 162. The upper edge of the pane fits with clearance in the channel 158 so that the window pane 160 can be fitted by initially inserting its upper edge fully into the channel 158. This will permit its lower edge to clear the bracket 154 located immediately below it and in which its bottom edge will rest. Thereafter, once it is aligned with the pair of brackets 154, it can be moved downwardly so that its bottom edge nestles in the bottom channel 156.

Figure 10:
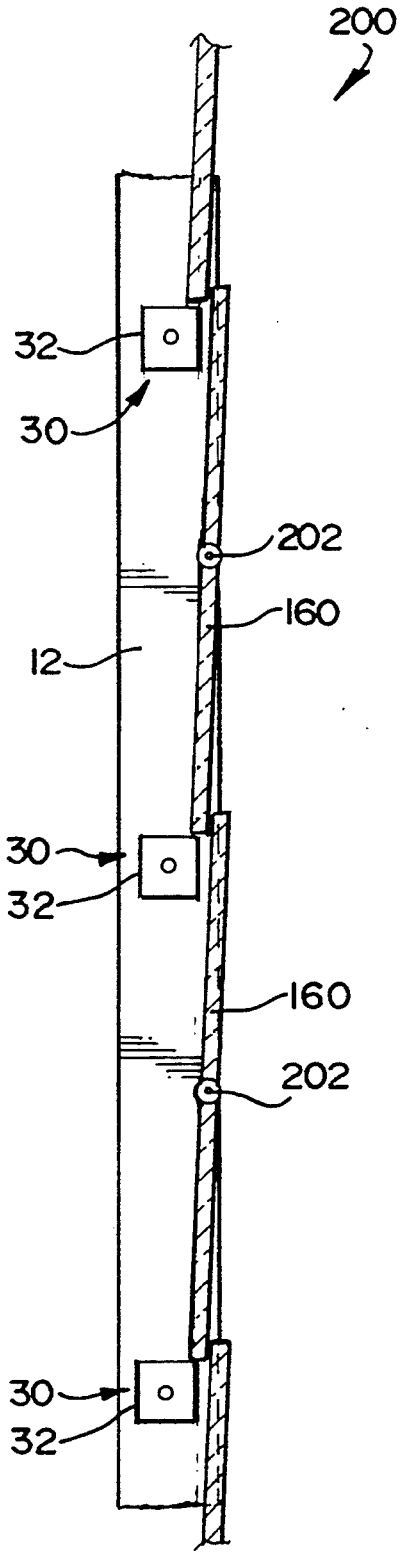
FIG. 10 shows a vertical sectional view of a security device according to a fourth embodiment of the invention.

Referring to FIG. 10, reference numeral 200 generally indicates a security device according to a fourth embodiment of the invention.

Parts of the device 200 which are the same or similar to those of the device 10, 100, 150, are indicated with the same reference numerals.

In the case of the device 200, the window panes 160 are pivotally mounted to the primary security members 12 by means of pivot pins 202, with the upper edges of the panes 160 abutting against the rear sides of the members 30 while their lower edges can pass with clearance over the adjacent members 30. This will permit the panes 160 to be opened louvre fashion.

It will be appreciated that a combination of the fixed window panes of FIG. 9 and the louvres of FIG. 10 can be provided. Furthermore, in the installations 150, 200 the components 34 can either be rotatably mounted within the components 32 as hereinbefore described, or fixedly located therein, with the potentially difference existing between the components as hereinbefore described.

The security devices according to the invention, apart from providing an alarm should they be breached or an attempt be made to breach them, also provide a delay and/or a deterrent to would-be intruders. The devices can also be assembled and installed quickly and easily in view of their kit or modular form. They are also of universal application since the components can be cut into suitable lengths to fit individual window openings.

Figure 11:
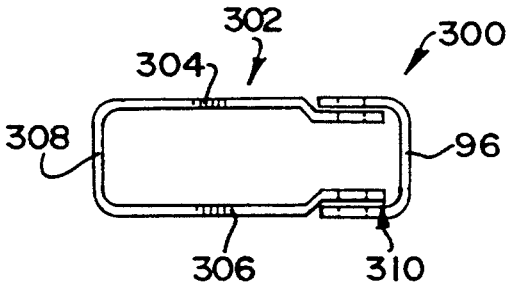
FIG. 11 shows a plan view of a tertiary security member according to another embodiment of the invention, for use in security devices according to the invention.
Figure 12:
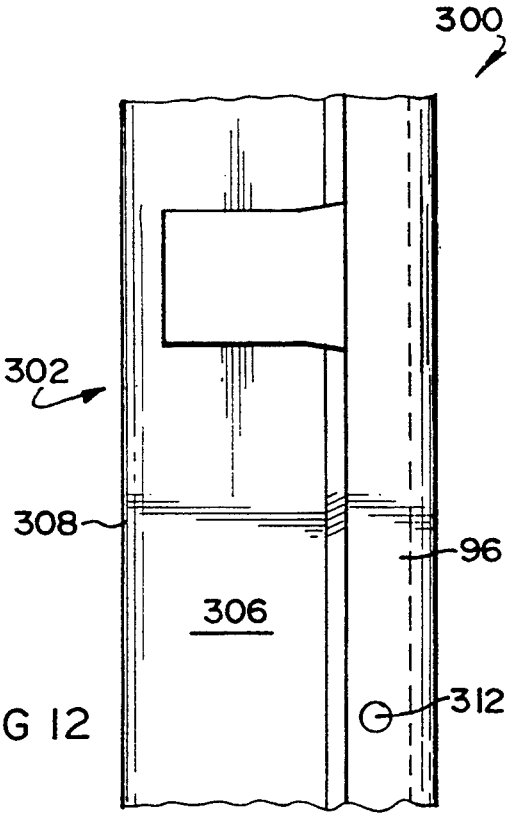
FIG. 12 shows, in part, side view of the tertiary security member of FIG. 11.

Referring to FIGS. 11 and 12, reference numeral 300 generally indicates a tertiary security member according to another embodiment of the invention. The tertiary security member 300 is suitable for use in the security devices according to the invention, as hereinbefore described with reference to FIGS. 1 to 10. Parts of the tertiary security member 300 which are the same or similar to those of the tertiary security member 90, are indicated with the same reference numerals.

The tertiary security member 300 comprises an elongate body 302. The body 302 is hollow and is of U-shaped form having a substantially planar side 304, a further substantially planar side 306 spaced from the side 304 and a connecting portion 308 interconnecting the sides 304, 306. The body 302 is provided with longitudinally spaced square openings similar to those of the tertiary security component 90, with the openings being accessible from the longitudinally extending side 310, which is opposite the portion 308, of the body 302. The sides 304, 306 are indented slightly along their edges remote from the portion 308, with the clip 96 fitting over these portions of the sides and being attached thereto by means of rivets (not shown) or the like which pass through openings 312.

Figure 13:
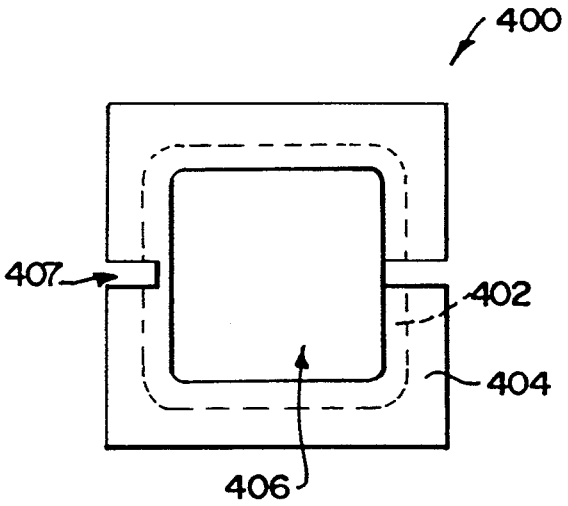
FIG. 13 shows a end view of an insulator or grommet suitable for use with the primary security member of FIG. 2 and the tertiary security member of FIG. 11.
Figure 14:
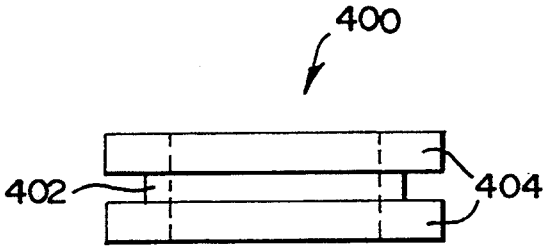
FIG. 14 shows a side view of the insulator of FIG. 13.

Referring to FIGS. 13 and 14, reference numeral 400 generally indicates an electrically insulative grommet suitable for use with the primary members 12 and tertiary security members 90 or 300 of FIGS. 1 to 12. For example, they can be used instead of the grommets 40.

The grommet 400 is dimensioned to fit within the openings provided in the sides 304, 306 of the tertiary security member 300 or in the openings in the panels 14 of the members 12, and comprises a body 402 which fits within the openings. On either side of the body there is provided a peripheral outwardly protruding flange or lip 404 which, in use, will abut against the planar surfaces of the side 304 or the side 306 of the member 300. The grommet also includes a central opening 406 for accommodating the components 30. Opposed slits 407 are provided in the flanges 404. These permit flexing of the grommet to ensure a snug fit over the members 34 and in the openings, especially when the openings are slightly undersize with respect to the grommet 402.

What is claimed is:

1. A security device kit, which comprises a pair of hollow elongate box section primary security members, with a plurality of longitudinally spaced openings being provided in a first side of each of the primary security members, with each primary security member including a cover panel which forms at least part of one of the sides of the box section;

a plurality of elongate secondary security members each having ends capable of being located in aligned openings in the primary security members when the first sides of the primary security members face each other, so that the ends of the secondary security members are thereby held captive in the primary security members, with the secondary security members spanning a space between the primary security members; and a tertiary security member having openings spaced longitudinally the same distance apart as the openings of the primary security members, the openings in said tertiary security member being shaped to accommodate and support the secondary security members between the primary security members.

2. A kit according to claim 1, wherein the tertiary security member is of box-section having first and second opposed panels containing the openings, the openings being accessible by means of inlets in longitudinally extending edges of the panels, and a cover member non-removably attachable to the panels so as to span the inlets to the openings once the tertiary security member is located in position with the secondary security members located in the openings, thereby holding the secondary security members captive in the openings.

3. A security device, which comprises a pair of spaced hollow box section elongate primary security members extending generally in a first direction, each having a plurality of longitudinally spaced openings in a first side thereof and including a cover plate which forms at least part of one of the sides of the box section;

a plurality of elongate secondary security members extending generally in a second direction which is orthogonal to the first direction, the secondary security members each having ends located in said openings of the primary security members so that said ends are thereby held captive in the primary security members, the secondary security members thus spanning a space between the primary security members and being spaced apart from one another; and a tertiary security member having openings spaced longitudinally along it the same distance apart as the openings of the primary security members, with the openings of said tertiary security member accommodating the secondary security members and the tertiary security member thus supporting the secondary security members between the primary security members.

4. A device according to claim 3, wherein the tertiary security member is of a box-section having first and second opposed panels containing the openings, the openings being accessible by means of inlets in the longitudinally extending edges of the panels, and a cover member non-removably attached to the panels and spanning the inlets to the openings, thereby holding the secondary security members captive in the openings.

5. A device according to claim 3, wherein each secondary security member comprises an outer elongate component which is hollow, an inner elongate component extending along an inside of the outer elongate component and spaced therefrom, with the inner and outer elongate components being electrically conductive and electrically connected or connectable to an electrical current such that a potential difference can be provided between them, and insulators electrically insulating the inner from the outer elongate components.

6. A security installation, which comprises a security device comprising a pair of spaced hollow elongate primary security members extending generally in a first direction, each having a plurality of longitudinally spaced openings in a first side thereof; and a plurality of elongate secondary security members extending generally in a second direction which is orthogonal to the first direction, the secondary security members having ends located in said openings of the primary security members so that said ends are thereby held captive in the primary security members, the secondary security members thus spanning a space between the primary security members and being spaced apart from one another, each secondary security member comprising an outer elongate component which is hollow, an inner elongate component extending along an inside of the outer component and spaced therefrom, with the inner and outer elongate components being electrically conductive and electrically connected or connectable to an electrical current such that a potential difference can be provided between them and insulators electrically insulating the inner from the outer elongate components; and an electrically operable burglar protection system operatively connected to the security device, the burglar protection system including an alarm, the inner elongate components being at a low electrical potential and the outer elongate components being at neutral voltage so that the security device is harmless under normal conditions, the inner elongate components being protected by the outer elongate components from outside interference so as to eliminate false alarms, and means for generating an alarm upon electrical bridging of the inner and outer elongate components.

7. A security installation according to claim 6, wherein the burglar protection system is such that the outer components are energized to deliver a non-lethal shock on touching thereof by an intruder, with the system including a control unit, operatively connected to the outer components, for introducing a high voltage to the outer components when the alarm is generated.

8. A security installation according to claim 7, wherein the control unit includes an electrical shock energizer electrically connected to the outer components of the device.

9. A security installation, which comprises a security device comprising a pair of spaced hollow elongate primary security members extending generally in a first direction, each having a plurality of longitudinally spaced openings in a first side thereof; and a plurality of elongate secondary security members extending generally in a second direction which is orthogonal to the first direction, the secondary security members having ends located in said openings of the primary security members so that said ends are thereby held captive in the primary security members, the secondary security members thus spanning a space between the primary security members and being spaced apart from one another, each secondary security member comprising an outer elongate component which is hollow, an inner elongate component extending along an inside of the outer elongate component and spaced therefrom, the inner and outer elongate components being electrically conductive and electrically connected or connectable to an electrical current such that a potential difference can be provided between them, and insulators electrically insulating the inner from the outer elongate components, and the inner and outer elongate components of the secondary security members being at different electrical potential; and an electrically operable burglar protection system operatively connected to the security device, the burglar protection system including an alarm, and being such that the outer elongate components of the secondary members are energized through the introduction of positive and negative electrical potential to alternative secondary members, thus resulting in potential differences between adjacent ones of the secondary security members.

10. A security installation which comprises a security device comprising a pair of spaced hollow elongate primary security members extending generally in a first direction, each having a plurality of longitudinally spaced openings in a first side thereof; and a plurality of elongate secondary security members extending generally in a second direction which is orthogonal to the first direction, the secondary security members having ends located in said openings of the primary security members so that said ends are thereby held captive in the primary security members, the secondary security members thus spanning a space between the primary security members and being spaced apart from one another, each secondary security member comprising an outer elongate component which is hollow, an inner elongate component extending along an inside of the outer elongate component and spaced therefrom, the inner and outer elongate components being electrically conductive and electrically connected or connectable to an electrical current such that a potential difference can be provided between them, and insulators electrically insulating the inner from the outer elongate components, each insulator comprising an elongate body protruding into the end of the outer elongate component, a peripheral flange protruding outwardly from the body at one end thereof and abutting against the end of an adjacent one of the secondary security members, and a passageway or recess in the body accommodating the inner elongate component; and an electrically operable burglar protection system operatively connected to the security device.

* * * * *